United States Patent [19]

McKee

[11] Patent Number: 4,569,349

[45] Date of Patent: Feb. 11, 1986

[54] PLASTIC MATERIAL SPRING COIL TEETHING AID ARTICLE

[76] Inventor: Kari L. McKee, 1232 S. Courtland Ave., Park Ridge, Ill. 60068

[21] Appl. No.: 645,837

[22] Filed: Aug. 31, 1984

[51] Int. Cl.[4] ..... A61J 17/00

[52] U.S. Cl. ..... 128/359

[58] Field of Search ..... 128/150, 359, 360; 604/77

[56] References Cited

U.S. PATENT DOCUMENTS

| | | | |
|---|---|---|---|
| 2,827,055 | 3/1958 | Carden | 128/359 |
| 3,267,937 | 8/1966 | Verschoor | 128/360 |
| 4,249,333 | 2/1981 | Chase et al. | 128/359 X |
| 4,311,149 | 1/1982 | Panicci | 128/359 |

FOREIGN PATENT DOCUMENTS

| | | | |
|---|---|---|---|
| 0588662 | 2/1925 | France | 128/359 |
| 0374517 | 6/1932 | United Kingdom | 128/359 |

*Primary Examiner*—John Doll
*Assistant Examiner*—William G. Wright
*Attorney, Agent, or Firm*—Wallenstein, Wagner, Hattis, Strampel & Aubel, Ltd.

[57] ABSTRACT

A child's teething aid article includes a teething portion constructed and arranged in the form of a helical coil spring from a cord-like length of resilient, nontoxic plastic material jacketing a flexible core member. The coil spring has an exterior diameter adapted to be received in the mouth of the child and presents a resilient mechanical force additional to the resilience of the material, against the compressive bite of the child applied normal to the coil spring axis. The teething portion is connected to a one or two part handle portion for manipulation of the article.

10 Claims, 3 Drawing Figures

PLASTIC MATERIAL SPRING COIL TEETHING AID ARTICLE

BACKGROUND OF THE INVENTION

This invention relates to articles used in aiding the teething of children, and in particular, relates to such articles that the child places in his or her mouth and bites upon.

Infant children help new teeth cut through their gums by biting on objects. Articles manufactured for this purpose heretofore have been made of resilient, solid materials such as rubber and plastics or have been made of tough, joined sheet materials enclosing a liquid or gas. In the former case, only the resilience of the bulk material resists the compressive bite of the child to aid teething. In the latter case, the bulk resiliency of the sheet material minimally joins with the resistance to compression of the enclosed liquid or gas to provide the resilience to the compressive bite of the child.

Some examples of these prior articles manufactured to aid teething are disclosed in the following references:

U.S. Pat. NO. Des. 254,860 Chase et al

U.S. Pat. No. 2,809,760 C. M. Clark

U.S. Pat. No. 2,827,055 M.E. Carden

U.S. Pat. No. 4,249,333 Chase et al.

It is desired to obtain an article providing resistance to a compressive bite other than through the bulk resilience of the plastic material used, without having to enclose a liquid or gas that can escape from the article.

SUMMARY OF THE INVENTION

In accordance with the invention, an article resists the compressive teething bite of an infant child, at least partially, through the use of a mechanical formation into which the material thereof has been formed. This is additional to the resistance or resilience to the compressive force exhibited by the bulk material of the article.

The article of the invention comprises a handle portion and a teething portion integrally joined together for easy manipulation thereof. The teething portion comprises a cord-like or long, thin and narrow length of plastic material that jackets a central core such as a string that is arranged into a helically wound coil spring formation. The spring formation has an exterior diameter adapted to be received in the mouth of a child who is teething and the plastic material is resilient and nontoxic. The mechanical qualities of the coil spring formation present a resilient force, additional to the bulk material resilience, to the compressive teething bit of the child applied perpendicular or normal to the axis of the spring formation. The advantage of the invention is the additional resilient force of the spring coil formation opposing the compressive teething bite of the child.

The handle portion can be such as a rod of plastic material, one end of which is integrally connected to both ends of the spring formation and the other end of which is joined to a novelty item or a fanciful configuration. Alternatively, the handle portion can comprise two segments, one at each end of the spring formation. In this case, one segment presents a suction cup for attaching the article to a surface while the other segment presents a loop fastener for attachment to other articles or the child's clothing.

The spring formation of the teething portion is obtained using conventional extrusion techniques enclosing a flexible core such as a string or as desired in the cord-like length of plastic material.

DESCRIPTION OF THE PREFERRED EMBODIMENT

Figure 1:
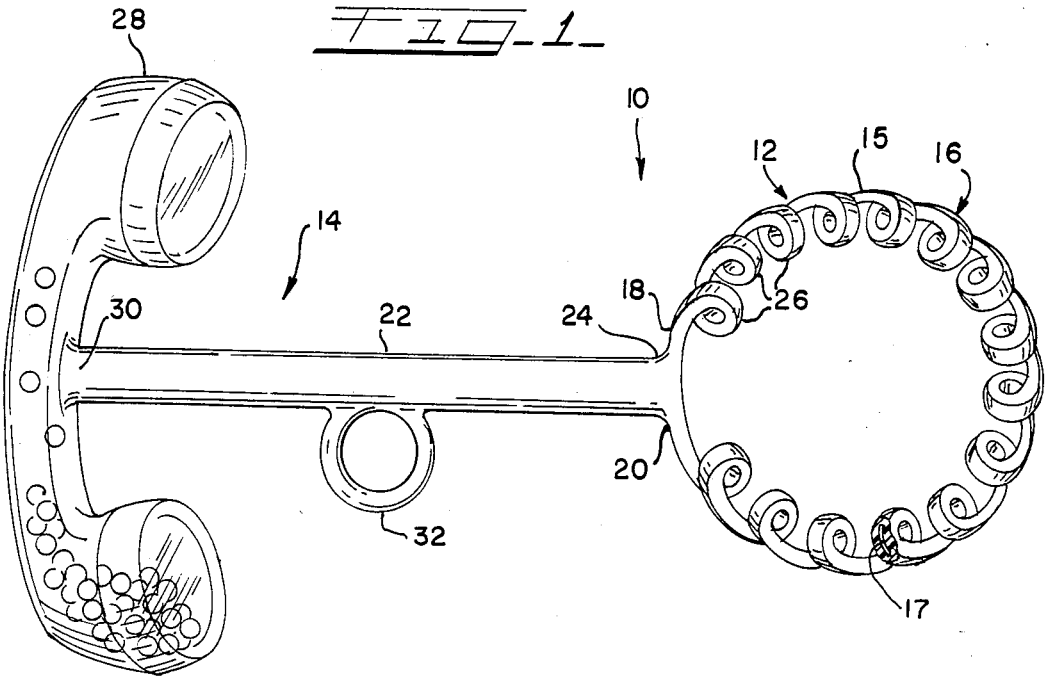
FIG. 1 is a plan view of a teething aid article embodying the invention.

The teething aid article of the invention illustrated in FIG. 1 is designated generally by the reference number 10. Teething aid 10 comprises a teething portion 12 and a handle portion 14. While any portion of the entire teething aid can be received in a child's mouth for biting thereon, handle portion 14 is intended for manipulation of the teething aid 10 and teething portion 12 is intended for aiding the teething of the child.

Teething portion 12 comprises a cord 15 of long, thin and narrow plastic material jacketing a length of string 17 forming a central core. Cord 15 is constructed and arranged in a helical coil spring formation 16. The ends 18 and 20 of formation 16, in this embodiment, are joined together and to a rod 22 at rod end 24. Thus joined, formation 16 is arranged substantially in a circle with the loops such as 26 of the formation 16 spaced from one another, such spacing providing for the child to bite on one loop at a time if desired.

The plastic material of the formation 16 is opaque, resilient and nontoxic and resists cutting by the child's teeth. An example of such a material is that produced by TEKNOR APEX of Pawtucket, Rhode Island known as FDA APEX-3378. This material is a polyvinylchloride having a durometer of approximately 80 on the Shore "A" hardness scale and is classified in U.S. Pharmacopia Class 6 for use in human contact.

The helical coil spring formation 16 is obtained by conventional extrusion of the specified material around a flexible core member. The material of the core member can be such as vegetable fibers wound into a string or as desired to obtain the helical formation.

The handle portion 14 includes the rod 22 and a novelty item 28, which is in the form of a telephone handset that is transparent, hollow and encloses a plurality of beads. Novelty item 28 is joined to rod 22 at end 30. Rod 22 can be formed of the same or a harder material than formation 16 to facilitate manipulation of teething portion 12. Rod 22 includes a loop 32 for tying the aid 10 to the child's clothing.

Figure 2:
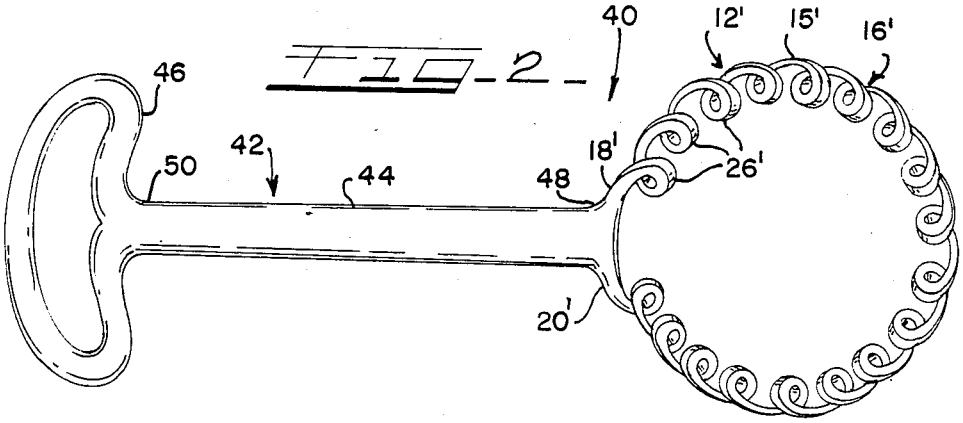
FIG. 2 is a plan view of a second embodiment of the article of the invention.

In FIG. 2, teething aid 40 comprises a teething portion 12' identical to that of teething aid 10, and like numbers are used to indicate like structures. Teething aid 40 further comprises a handle portion 42 including a rod 44 and a grasping part 46. One end 48 of rod 44 is integrally joined to spring formation 16' at the ends 18' and 20' thereof while the other end 50 of rod 44 is joined to grasping part 46. Handle portion 42 can be formed of material identical to that of teething portion 12' or it can be formed of a handle material to facilitate manipulation of teething part 12' by the child.

Figure 3:
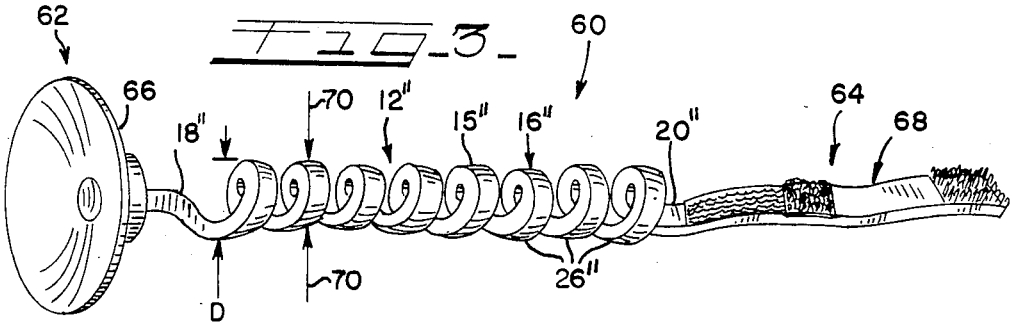
FIG. 3 is a perspective view of a third embodiment of the article of the invention in which the handle portion is in two segments.

In FIG. 3, teething aid 60 comprises a teething portion 12'' again identical to that of teething aid 10, and again, like numbers are used to indicate like structures. Teething aid 60 further comprises a handle portion of two segments 62 and 64. One end 18'' of spring formation 16'' is joined to segment 62, which is a suction cup 66 for attaching the teething aid 60 to a flat, smooth surface (not shown). The other end 20'' of spring formation 16'' is joined to loop fastener means 68 for attaching aid 60 to the clothing of the child or another article. Fastener means 68 include the hook and loop fastener materials sold under the trademark VELCRO and could include a simple snap arrangement.

The diameter D of helical spring coil formation 16'' is indicated in FIG. 3 and is selected to be received easily in the mouth of a child that is teething. Spring formations 16 and 16' have like diameters. Spring formation 16'' presents a resistive or resilient force to the compressive biting force applied thereto by the child in a direction indicated by arrows 70, normal to the longitudinal axis of the formation extending through the loops 26'' thereof. This resilient force is believed to be provided primarily by the mechanical coil spring action of the helical spring coil formation and can be supplemented by the spring action of the jacketed core, and is separate from the resilience provided by the bulk of the material forming the spring coil.

The invention thus provides a teething aid article having a resistance or resilience to a compressive bite separate from and additional to the bulk resilience of the article material. This is obtained without the need to enclose a gas or liquid in a resilient material and thus avoids the possible mess of leaking liquid.

The invention differs from electrical cords that are arranged in helical spring coils. Such electrical cords are formed of a plastic jacket material enclosing a plurality of insulated electrical conductors and are intended to provide an extensible length of cord in a small space, i.e. they are to be stretched longitudinally of the spring coil axis. Further, such cords often are dragged across floors and table tops to become dirty. No thought previously has been given to changing from the possibly toxic jacketing material to a nontoxic material and no thought previously has been given to using other than the longitudinal extensibility of such a cord or other such helically wound spring coil. The invention herein revolves around the use of a nontoxic material that jackets a central core and that is arranged in a helical spring coil formation for resisting bite forces applied perpendicular or normal to the spring coil axis.

Modifications of the present embodiments and teachings are possible while remaining within the scope of the invention described in the appended claims. For example, varying handle portions can be arranged to be held by one or both hands of the child and the manner of obtaining the helical spring coil formation can be varied.

I claim:

1. An article for aiding teething of a child, and including a handle portion adapted to be held by the child, the article comprising:

a teething aid portion connected to the handle portion and having a long, thin and narrow cord of plastic material that jackets a flexible central core, and that is arranged into a helical spring coil formation, the plastic material being resilient and nontoxic to the bite of a child, and the helical spring coil formation having an exterior diameter adapted to be received in the child's mouth, the helical coil spring formation, additional to the resiliency of the material thereof, presenting a mechanical resilient force to a compressive bite of the child applied normal to the axis of the helical coil spring formation.

2. The article of claim 1 in which the handle portion includes a rod carrying a novelty item on one end hereof and the two ends of the spring coil formation are joined together and to the other end of the rod.

3. The article of claim 2 in which the spring coil formation includes loops thereof that are spaced one from the other.

4. The article of claim 1 in which the handle portion includes two segments with one segment being joined to each end of the spring coil formation, one of said segments including a suction cup for fastening to a smooth, flat surface and the other segment including a fastener for attaching the article to another desired article.

5. The article of claim 1 in which the plastic material has a durometer of approximately 80 on the Shore "A" hardness scale, is a polyvinylchloride and is classified in United States Pharmacopia Class 6 for use in human contact.

6. The article of claim 1 in which the plastic material is extruded around a string core to jacket same.

7. An article for aiding teething of a child comprising:

A. a handle portion adapted to be held by the child; and

B. a teething aid portion connected to the handle portion and having a long, thin and narrow cord of plastic material extruded around a flexible, central core of string, the cord being arranged into a helical spring coil formation, the plastic material being a resilient, polyvinylchloride material having a durometer of approximately 80 on the Shore "A" hardness scale and being classified in United States Pharmacopia Class 6 for use in human contact, the spring coil formation having an exterior diameter adapted to be received in the child's mouth and presenting a mechanical resilient force to a compressive bite of the child applied normal to the longitudinal axis of the spring coil formation separate from and additional to the resilience of the plastic material.

8. The article of claim 7 in which said handle portion is a rod carrying a novelty item attached thereto at one end and the two ends of said cord are joined together and to the other end of a rod.

9. The article of claim 7 in which said handle portion includes two segments, one segment joined to each end of said cord, one segment including a suction cup adapted to be fastened to a smooth flat surface and the other segment including fastener means for fastening the article to another desired article.

10. An article for aiding teething of a child comprising:

A. a handle portion adapted for holding the article; and

B. a teething aid portion connected to the handle portion and having a long, thin and narrow cord of plastic material that is arranged into a helical spring coil formation, the plastic material being a resilient, polyvinylchloride material having a durometer of approximately 80 on the Shore "A" hardness scale and being classified in United State Pharmacopia Class 6 for use in human contact, the spring coil formation having an exterior diameter adapted to be received in the child's mouth and presenting a mechanical resilient force to a compressive bite of the child applied normal to the longitudinal axis of the spring coil formation separate from and additional to the resilience of the plastic material.

* * * * *